US010260177B2

(12) United States Patent
Jain

(10) Patent No.: US 10,260,177 B2
(45) Date of Patent: Apr. 16, 2019

(54) TEXTILE MATERIAL AND FABRICATION METHOD

(71) Applicant: INDO COUNT INDUSTRIES LTD., Mumbai (IN)

(72) Inventor: Anil Kumar Jain, Mumbai (IN)

(73) Assignee: NEOMED, INC., Woodstock, GA (US)

( * ) Notice: Subject to any disclaimer, the term of this patent is extended or adjusted under 35 U.S.C. 154(b) by 0 days.

(21) Appl. No.: 15/432,129

(22) Filed: Feb. 14, 2017

(65) Prior Publication Data

US 2017/0233905 A1 Aug. 17, 2017

Related U.S. Application Data

(60) Provisional application No. 62/295,865, filed on Feb. 16, 2016, provisional application No. 62/411,899, filed on Oct. 24, 2016.

(51) Int. Cl.

| | |
|---|---|
| ***D03D 15/00*** | (2006.01) |
| ***D02G 3/04*** | (2006.01) |
| ***D02G 3/38*** | (2006.01) |
| ***D03D 11/00*** | (2006.01) |
| *D03D 1/00* | (2006.01) |

(52) U.S. Cl.

CPC ..... *D03D 15/00* (2013.01); *D02G 3/042* (2013.01); *D02G 3/38* (2013.01); *D03D 11/00* (2013.01); *D10B 2201/02* (2013.01); *D10B 2503/06* (2013.01)

(58) Field of Classification Search

CPC .. A47G 9/0246; D03D 15/00; D10B 2201/02; D10B 2503/06; D10B 2505/08

See application file for complete search history.

(56) References Cited

U.S. PATENT DOCUMENTS

| | | | | |
|---|---|---|---|---|
| 4,900,613 | A | 2/1990 | Green | |
| 5,427,156 | A * | 6/1995 | Saito | D03D 15/00 139/420 B |
| 8,813,280 | B1 * | 8/2014 | Arora | A47G 9/0246 5/482 |
| 2010/0279282 | A1 * | 11/2010 | Liang | C12Q 1/6895 435/6.12 |

(Continued)

FOREIGN PATENT DOCUMENTS

| | | | |
|---|---|---|---|
| CN | 101469477 | A | 7/2009 |
| CN | 104153094 | A | 11/2014 |

(Continued)

OTHER PUBLICATIONS

Khadi et al., "Suvin" in the office action, Extra long staple cotton in India and World, Dec. 2007, Central institute for Cotton research.*

(Continued)

*Primary Examiner* — Robert H Muromoto, Jr.
(74) *Attorney, Agent, or Firm* — Gardner Groff Greenwald Villanueva, PC

(57) ABSTRACT

A woven fabric includes a plurality of warp and weft yarns. The yarn is formed by a combination of extra long staple cotton and Suvin cotton, which is spun together at a low speed on a ring frame. In alternate example embodiments, the yarn is formed by a combination of long staple cotton and Suvin cotton.

14 Claims, 2 Drawing Sheets

| KNOWN FABRICS | | | | | | |
|---|---|---|---|---|---|---|
| TC | CONSTRUCTION | WEAVE | GSM | DC | CR-WARP | CR-WEFT |
| 600 | 80s X 100s/216 X 94/4 | 5 END SATEEN | 163 | 73.64% | 67 | 111 |
| 800 | 100s X 120s/236 X 96/6 | 5 END SATEEN | 172 | 83.32% | 89 | 133 |
| 1000 | 100s X 120s/240 X 95/8 | 5 END SATEEN | 215 | 95.50% | 32 | 85 |

| FABRIC OF PRESENT INVENTION | | | | | | |
|---|---|---|---|---|---|---|
| TC | CONSTRUCTION | WEAVE | GSM | DC | CR-WARP | CR-WEFT |
| 600 | 100s X 120s/232 X 92/4 | 8 END SATEEN | 134 | 42.03% | 140 | 98 |
| 800 | 100s X 120s/226 X 96/6 | 8 END SATEEN | 167 | 43.08% | 135 | 78 |
| 1000 | 100s X 135s/232 X 96/8 | 8 END SATEEN | 190 | 47.06% | 151 | 81 |

(56) References Cited

U.S. PATENT DOCUMENTS

| | | | | |
|---|---|---|---|---|
| 2010/0332009 | A1* | 12/2010 | Hooper | A47G 9/10 700/103 |
| 2012/0066875 | A1* | 3/2012 | Wootten, Jr. | G01N 33/367 26/1 |
| 2015/0232952 | A1* | 8/2015 | Sun | C12Q 1/6895 506/9 |

FOREIGN PATENT DOCUMENTS

| | | | |
|---|---|---|---|
| CN | 104233564 | A | 12/2014 |
| CN | 104651998 | A | 5/2015 |
| CN | 104073953 | B | 10/2015 |
| CN | 103334190 | B | 1/2016 |
| EP | 0913509 | A1 | 5/1999 |

OTHER PUBLICATIONS

SEarch report for WO 2017141107 A1.*

Cotton Species—Truth About Thread Count; http://www.truthaboutthreadcount.com/cotton_species.html; date unknown; 2 pgs.

Gupte, A.A.; Characteristics of Imperfections in Cotton & Blend Yarns; Indian Journal of Textile Research, vol. 13, pp. 192-197; Dec. 1988.

Samanta, Ashis Kumar et al.; Study of the Effect of Different Woven Structures on Physical Properties of Cotton Muslin Fabric; Journal of Natural Fibers 12.5; pp. 444-456; Oct. 7, 2015.

Specialty (Organic, Suvin and ELS) Cotton; http://www.organiccotton.org/oc/wGlobal/scripts/listen/files/b15d9e446ff7ea2fabfd0e2857c898f1.pdf; 50 pgs; date unknown.

Spoerry 1866 AG: Sales Programme Spoerry 1866; The Best From Five Continents—Cooling Fabric, Fresh Cotton; Jun. 2013; 2 pgs.

Ying, Guo et al.; Investigation & Evaluation on Fine Upland Cotton Blend Yarns Made by the Modified Ring Spinning System; Textile Research Journal, vol. 85, No. 13; pp. 1355-1366; Jan. 7, 2015.

* cited by examiner

| KNOWN FABRICS | | | | | | |
|---|---|---|---|---|---|---|
| TC | CONSTRUCTION | WEAVE | GSM | DC | CR-WARP | CR-WEFT |
| 600 | 80s X 100s/216 X 94/4 | 5 END SATEEN | 163 | 73.64% | 67 | 111 |
| 800 | 100s X 120s/236 X 96/6 | 5 END SATEEN | 172 | 83.32% | 89 | 133 |
| 1000 | 100s X 120s/240 X 95/8 | 5 END SATEEN | 215 | 95.50% | 32 | 85 |

| FABRIC OF PRESENT INVENTION | | | | | | |
|---|---|---|---|---|---|---|
| TC | CONSTRUCTION | WEAVE | GSM | DC | CR-WARP | CR-WEFT |
| 600 | 100s X 120s/232 X 92/4 | 8 END SATEEN | 134 | 42.03% | 140 | 98 |
| 800 | 100s X 120s/226 X 96/6 | 8 END SATEEN | 167 | 43.08% | 135 | 78 |
| 1000 | 100s X 135s/232 X 96/8 | 8 END SATEEN | 190 | 47.06% | 151 | 81 |

TEXTILE MATERIAL AND FABRICATION METHOD

CROSS-REFERENCE TO RELATED APPLICATIONS

This application claims priority to U.S. Provisional Patent Application Ser. No. 62/295,865 filed Feb. 16, 2016 and U.S. Provisional Patent Application Ser. No. 62/411,899 filed Oct. 24, 2016, the entireties of which are hereby incorporated by reference herein.

TECHNICAL FIELD

The present invention relates generally to the field of textiles, and more particularly to fabrics, and to weaving and spinning fabrication methods for making fabrics, for example to use in bedding products.

BACKGROUND

Bedding products including sheets, pillow cases, duvet and duvet covers, blankets, quilts, etc. are typically constructed from cotton or other fabrics. Depending on the yarns utilized for weaving the fabric and the thread count thereof, the resulting fabric can comprise a variety of different characteristics. For example, higher thread count fabrics are typically considered superior to lower thread count fabrics in terms of hand feel (or handle) and comfort. However, fabrics with higher thread counts are typically less breathable and lose their handle and shine after repeated washes due to their weave structure and construction. Thus, typically as the thread count increases, the fabric becomes less breathable and harsh in feel and handling, and loses its properties after washing. Low thread count fabrics are often rough to the touch and uncomfortable as compared to high thread count fabrics, but are more breathable and generally wear less after numerous washing cycles.

Accordingly, it can be seen that needs exist for a fabric with the feel and comfort of a higher thread count fabric, but the breathability and durability of a lower thread count fabric. It is to the provision of a textile material and methods of fabrication thereof meeting these and other needs that the present invention is primarily directed.

SUMMARY

In example embodiments, the present invention relates to a textile material or fabric, for example for use in bedding products. In example forms, the fabric is formed from a yarn including extra long staple cotton and Suvin cotton. In alternate example embodiments, the fabric is formed from long staple cotton and Suvin cotton. In one aspect, the present invention relates to a fabric woven from a plurality of warp and weft yarns. The yarn includes a combination of extra long staple cotton and Suvin cotton. According to example forms, the cottons are spun together at a low speed on ring frames.

According to example forms, the fabric's weave structure is in the form of an 8 end sateen weave. In some forms, the extra long staple cotton is blended with Suvin cotton at a ratio of between about 85:15 to about 90:10. Generally, the drape coefficient of the woven fabric is between about 40% to about 50%. In some example forms, the fabric weighs between about 120 to about 200 grams per square meter. In alternate example embodiments, long staple cotton is blended with Suvin cotton at a ratio of between about 85:15 to about 90:10.

In another aspect, the invention relates to a woven fabric formed a plurality of warp and weft yarns. The yarn includes a combination of extra long staple cotton and Suvin cotton, wherein the cottons are spun together at a low speed on a ring frame. In example embodiments, the fabric is in the form of an 8-end sateen weave structure. In example embodiments, the float size is between about 1 millimeter to about 2 millimeters. In example embodiments, the extra long staple cotton is blended with Suvin cotton at a ratio of between about 85:15 to about 90:10. In example embodiments, the drape coefficient is between about 40% to about 50%. In example embodiments, the fabric weighs between about 120-190 grams per square meter. In example embodiments, the fabric has a surface index value of between about 2.6 to about 3.6. Optionally, the fabric has a surface index value of between about 2.8 to about 3.0.

According to one example embodiment, with the thread count of the woven fabric being 600, the fabric weighs about 134 grams per square meter, the drape coefficient is about 42%, the crease recovery value in the warp direction is about 140, and the crease recovery value in the weft direction is about 98. According to one example embodiment, with the thread count of the woven fabric being 800, the fabric weighs about 167 grams per square meter, the drape coefficient is about 43%, the crease recovery value in the warp direction is about 135, and the crease recovery value in the weft direction is about 78. According to one example embodiment, with the thread count of the woven fabric being 1000, the fabric weighs about 190 grams per square meter, the drape coefficient is about 47%, the crease recovery value in the warp direction is about 151, and the crease recovery value in the weft direction is about 81.

In another aspect, the invention relates to a woven fabric formed a plurality of warp and weft yarns. The yarn includes a combination of long staple cotton and Suvin cotton wherein the cottons are spun together at a low speed on a ring frame. In example embodiments, the fabric is in the form of an 8-end sateen weave structure. In example embodiments, the float size is between about 1 millimeter to about 2 millimeters. In example embodiments, the extra long staple cotton is blended with Suvin cotton at a ratio of between about 85:15 to about 90:10. In example embodiments, the drape coefficient is between about 40% to about 50%. In example embodiments, the fabric weighs between about 120-190 grams per square meter. In example embodiments, the fabric has a surface index value of between about 2.6 to about 3.6. Optionally, the fabric has a surface index value of between about 2.8 to about 3.0.

In another aspect, the invention relates to a method of forming a fabric including loading a first cotton on a ring frame; loading a second cotton on a ring frame; spinning the first cotton with the second cotton at a low speed on the ring fame to form a yarn; loading the yarn on a loom; and using the loom to weave the yarn in the warp and weft directions to form the fabric. In example embodiments, the fabric includes a weave configuration in the form of an 8-end sateen weave. In example embodiments, the first cotton is blended with the second cotton at a ratio of between about 85:15 to about 90:10, wherein the drape coefficient is between about 40% to about 50%, and wherein the fabric weight is between about 120-190 grams per square meter. In example embodiments, the first cotton includes extra long staple cotton and the second cotton comprises Suvin cotton.

Optionally, the first cotton includes long staple cotton and the second cotton comprises Suvin cotton.

In yet another aspect, the present invention relates to a textile material or fabric, for example for use in bedding products. In example forms, the fabric is formed from a yarn including long staple cotton and Suvin cotton. In one aspect, the present invention relates to a fabric woven from a plurality of warp and weft yarns. The yarn includes a combination of long staple cotton and Suvin cotton. According to example forms, the cottons are spun together at a low speed on ring frames.

In example embodiments, the fabric's weave structure is in the form of an 8 end sateen weave. In example forms, long staple cotton is blended with Suvin cotton at a ratio of between about 85:15 to about 90:10. Generally, the drape coefficient of the woven fabric is between about 40% to about 50%. In example forms, the fabric weighs between about 120 to about 200 grams per square meter.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of example embodiments of the invention, and are not restrictive of the invention, as claimed.

DETAILED DESCRIPTION OF EXAMPLE EMBODIMENTS

Figure 1:
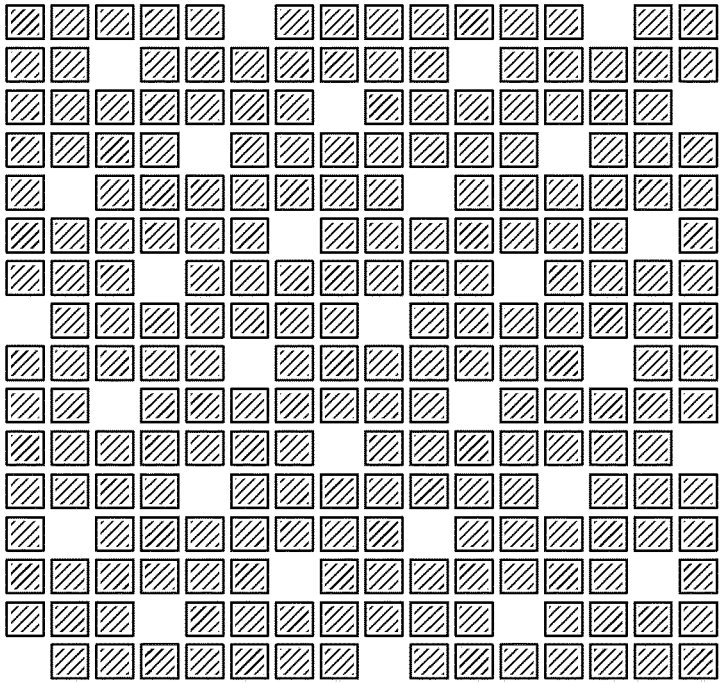
FIG. 1 is a diagram showing a 2-dimensional representation of an 8 end sateen weave structure according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

According to example forms, the present invention relates to a fabric comprising exceptionally soft hand feel and luxurious shine, which maintains its softness and luster after multiple washes. In example applications, the fabric of the present invention is used to produce bedding products including sheets, pillow cases, duvets and duvet covers, blankets, quilts, etc. According to one example form, the present invention relates to a woven cotton fabric formed from a plurality of warp and weft yarns. In example forms, the yarn is in the form of a single ply yarn having a combination of extra long staple (ELS) cotton and Suvin cotton. Generally, the extra long staple cotton and the Suvin cotton are spun together at a low speed on ring frames to form a uniformly smooth single ply yarn. In example forms, spinning the cottons together at a low speed on a ring frame ensures the surface of the resulting single ply yarn stays smooth and flawless. The uniformly smooth single ply yarn is then woven to form a fabric. Preferably, the weave construction is modified to comprise a longer weave float size X ranging from about 1.5 mm to 2 mm (e.g., the gap between two weave stitches—see FIG. 1), and light weight yarn counts, which allow the fabric more breathability and provide maximum comfort during use. In example forms, the float size is generally between about 0.125 millimeters to about 5 millimeters, more preferably between about 0.5 millimeters to about 2.5 millimeters, for example between about 1.5 millimeters to about 2 millimeters according to example embodiments. Generally, the light-weight yarn count is generally between about 60 s to about 150 s and above, and more preferably between about 60 s to about 100 s. In alternate example embodiments, as will be described below, the yarn can be in the form of a single ply yarn having a combination of long staple (LS) cotton and Suvin cotton.

Figure 2:
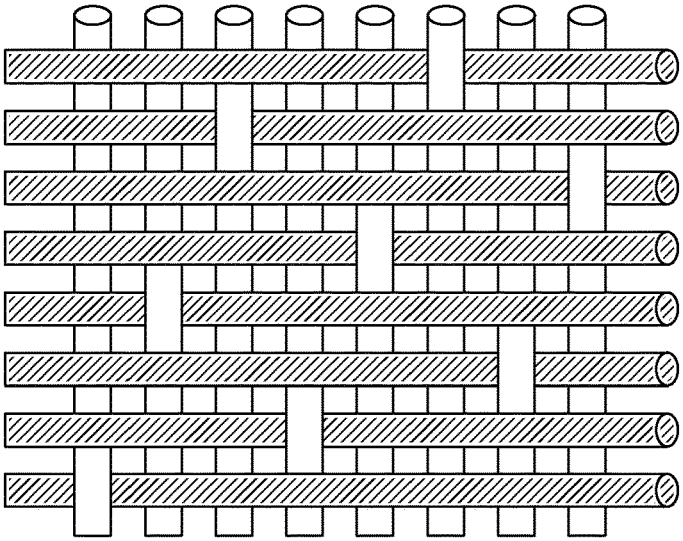
FIG. 2 is a diagram showing a 3-dimensional representation of the 8 end sateen weave structure of FIG. 1.
Figures 3, 4:
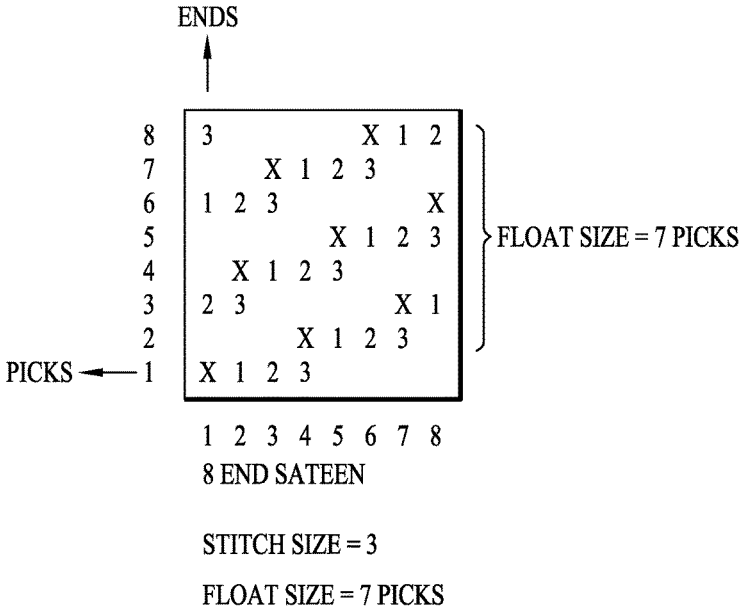
FIG. 3 shows a weaving diagram for 8 end sateen weave according to an example embodiment of the present invention.
FIG. 4 is a table showing the drape coefficient, weight and crease recovery values of known fabrics relative to the fabric of the present invention.

As depicted in FIGS. 1-3, the weave structure for forming the fabric is in the form of an 8 end sateen weave. Preferably, the 8 end sateen weave makes the fabric more breathable with less interlacement, thereby resulting in a drastic improvement in the fabric handle, drape and look. For example, in example embodiments the 8 end sateen weave comprises a float size X of between about 1.5 millimeters to about 2 millimeters. In addition, finer yarn counts are utilized rather than the conventional coarser yarn counts. For example, a known or conventional 600 thread count (TC), 5 end sateen woven with construction 80 s in warp and 100 s in weft, and 216 ends per inch and 92/4 Px insertion px per inch has a weight of about 163 grams per square meter, which is substantially more than the weight (e.g., grams per square meter) of the present invention, for example, which is about 134 grams per meter according to some example forms (as will be described below).

According to example forms, the drape coefficient and crease recovery of the fabric described herein is substantially superior to that of known fabrics. For example, the drape of fabric is a term used to describe the way a fabric hangs under its own weight. According to example embodiments, the drape of the fabric (or drapeability) is measured by a drapemeter or drape tester, for example, which is outlined in Indian Standards Institution "Method for Assessment of Fabric Drape" by Manak Bhavan (IS: 8357 (1977)). In some example forms, the drape plays an important bearing on how good a garment looks in use. The draping qualities required from a fabric will differ completely depending on its end use, and thus, a given value for drape cannot be classified as either good or bad. Generally, knitted fabrics are relatively floppy and garments made from them will tend to follow the body contours. However, woven fabrics are relatively stiff when compared with knitted fabrics so they are used in tailored clothing where the fabric hangs away from the body and disguises its contours. The measurement of a fabric's drape is meant to assess its ability to do this and also its ability to hang in graceful curves. Typically, the higher the fabric drape coefficient, the stiffer the fabric and thereby makes its fabric drapability lower. As shown in FIG. 4, the weight (GSM) and drape coefficient (DC) of the presently claimed fabric is compared to the weight (GSM) and drape coefficient (DC) of typical fabric. The typical fabric is provided with a 5 end sateen weave, for example, wherein a 600 thread count fabric comprises a construction of 80 s×100 s/216×94/4 and a GSM (grams per square meter) value of 163, wherein an 800 thread count fabric comprises a construction of 100 s×120 s/236×96/6 and a GSM value of 172, and wherein a 1000 thread count fabric comprises a construction of 100 s×120 s/240×95/8 and a GSM value of 215. The fabric of the presently claimed invention is provided with an 8 end sateen weave, for example, wherein a 600 thread count fabric comprises a construction of 100 s×120 s/232×92/4 and a GSM value of 134, wherein a 800 thread count fabric comprises a construction of 100 s×120 s/226×96/6 and a GSM value of 167, and wherein a 1000 thread count fabric comprises a construction of 100 s×135 s/232×96/8 and a GSM value of 190. For 600 thread count fabric, the drape coefficient for typical fabric is 73.64% whereas the drape coefficient for the fabric of the presently claimed invention is 42.03%. For 800 thread count fabric, the drape coefficient for typical fabric is 83.32% whereas the drape coefficient for the fabric of the presently claimed invention is 43.08%. And, for 1000 thread count fabric, the drape coefficient for typical fabric is 95.50% whereas the drape coefficient for the fabric of the present invention is 47.06%. Generally, in most example embodiments, the fabric of the present invention will comprise a drape coefficient within the range of between about 40%-50%, for example which is generally between about 25%-55% less than that of known fabrics.

Furthermore, as depicted in FIG. 4, the crease recovery of the fabric of the presently claimed invention is far superior to known fabrics. For example, crease recovery is a ratio of a projected pleating fold area formed by a piece of fabric after draping under its own weight relative to the original area of the same piece of fabric without draping. Thus, more or less, crease recovery is the ability of a creased or wrinkled fabric to recover its original shape over time. In example embodiments, for a 600 thread count fabric, the crease recovery values for conventional fabric is 67 in the warp direction and 111 in the weft direction, and the crease recovery values for the fabric of the presently claimed invention is 140 in the warp direction and 98 in the weft direction. For an 800 thread count fabric, the crease recovery values for conventional fabric is 89 in the warp direction and 133 in the weft direction, and the crease recovery values for the presently claimed invention is 135 in the warp direction and 78 in the weft direction. For 1000 thread count fabric, the crease recovery values for conventional fabric is 32 in the warp direction and 85 in the weft direction, and the crease recovery values for the fabric of the presently claimed invention is 151 in the warp direction and 81 in the weft direction.

According to example forms, the fabric of the present invention generally comprises an 8 end sateen weave structure. The warp count is generally about 100 s for fabrics of 600, 800 and 1000 thread counts. A lower thread count below 600 is achievable; however, it is generally with a PPI (picks per inch) of 90 and above. In example forms, the extra long staple (ELS) cotton is spun together with Suvin cotton at a ratio of between about 85:15 to about 90:10 at a low speed on a ring frame. In alternate embodiments, as will be described below, the long staple (LS) cotton is spun together with Suvin cotton at a ratio of between about 85:15 to about 90:10 at a low speed on a ring frame. Generally, the weight of the fabric (e.g., GSM) of the present invention is generally between 120-200 g/m$^2$. The weave float size X can generally be less than 1 mm up to about 2 mm. In some example forms, the fabric of the present invention can be a multi pick insertion fabric where the picks are generally to be in multiples of 90 pc. For example, for 600 thread count fabric, the picks are 92/4, for 800 thread count fabric, the picks are 94/6, and for 1000 thread count fabric, the picks are 96/8 (see FIG. 4). In some example forms, the weft is a multi pick insertion that runs parallel on the loom apparatus. For example, for 600 thread count fabric, the weaver of the fabric can weave up to 236 ends per inch (e.g., warp density per inch) and the remaining (e.g., 600−236=368) thread is inserted by multi-pick insertion (e.g., 368 pick with 4 pick insertion=368/4=92×4). Preferably, the fabric of the present invention is between about 2-25% lighter than known fabrics. According to example embodiments, the formula for calculating fabric weight is defined by: fabric weight (GSM) =(EPI/warp count+PPI/weft count)×25.

In another example embodiment, the present invention relates to a method of forming a fabric comprising providing a first cotton; providing a second cotton; spinning the first cotton with the second cotton at a low speed on a ring frame to form a yarn; providing a loom; and using the loom to weave the yarn in the warp and weft directions to form the fabric. According to some example forms, the fabric comprises a weave configuration in the form of an 8 end sateen weave. According to example embodiments, the first cotton comprises extra long staple cotton (ELS) and the second cotton comprises Suvin cotton. Generally, the weave float size is between about 1 millimeter to about 2 millimeters.

Optionally, the method of forming a fabric can comprise loading a first cotton on a ring frame; loading a second cotton on a ring frame; spinning the first cotton with the second cotton at a low speed on the ring fame to form a yarn; loading the yarn on a loom; and using the loom to weave the yarn in the warp and weft directions to form the fabric. In example embodiments, the fabric comprises a weave configuration in the form of an 8-end sateen weave. In example embodiments, the first cotton is blended with the second cotton at a ratio of between about 85:15 to about 90:10, wherein the drape coefficient is between about 40% to about 50%, and wherein the fabric weight is between about 120-190 grams per square meter. In example embodiments, the first cotton comprises extra long staple cotton and the second cotton comprises Suvin cotton. Optionally, the first cotton comprises long staple cotton and the second cotton comprises Suvin cotton.

In further example embodiments, the present invention includes one or more bedding products including sheets, pillow cases, duvets and duvet covers, blankets, quilts, etc., fabricated from a fabric as disclosed herein.

In yet another example embodiment, the fabric of the present invention comprises a surface index value that is between about 15% to about 20% better than known conventional fabrics. The surface index of the fabric describes the smoothness or hairiness of the fabric. For example, according to one method, a camera records an image of a cross-section of the textile in which the number and size of the protruding fibers in the fabric are calculated. The surface index can be used to judge, for example, whether a textile will scratch or feel too smooth. In example embodiments, the index is determined by the number and length of the fiber ends protruding from the fabric's bulk. Typically, the surface index value comprises a range of between about 2-15, where 2 is generally a substantially smooth feel and wherein 15 is generally a substantially rough feel. According to example embodiments, the surface index value of the fabric of the present invention is between about 2.4 to about 4.0, for example between about 2.6 to about 3.6, for example between about 2.8 to about 3.0 according to one example embodiment.

According to another example embodiment of the present invention, at least one of the cotton materials can be modified or varied according to additional example embodiments of the present invention. For example, rather than the extra long staple (ELS) cotton being spun together with Suvin cotton at a ratio of between about 85:15 to about 90:10, long staple cotton (LS) can be spun together with Suvin cotton at a ratio of between about 85:15 to about 90:10. For example, in a similar process as described above with respect to the yarn comprising extra long staple cotton (ELS) and Suvin cotton, the same process, techniques, etc. can similarly be applied to the yarn formed from long staple cotton (LS) and Suvin cotton. Accordingly, one or more woven fabrics can be formed from yarn comprising long staple cotton (LS) and Suvin cotton.

Furthermore, with respect to the method of forming a fabric as described above, the first cotton can comprise long staple cotton (LS) and the second cotton can comprise the Suvin cotton. Accordingly, the method of forming a fabric can comprise providing a first cotton; providing a second cotton; spinning the first cotton with the second cotton at a low speed on a ring frame to form a yarn; providing a loom; and using the loom to weave the yarn in the warp and weft directions to form the fabric. In example embodiments, the fabric similarly comprises a weave configuration in the form of an 8 end sateen weave. As mentioned above, the first cotton comprises long staple cotton (LS) and the second cotton comprises Suvin cotton. Generally, the weave float size is between about 1 millimeter to about 2 millimeters.

In yet another example embodiment, the fabric of the present invention can be formed from any combination of Suvin cotton, long staple cotton (LS) and extra long staple cotton (ELS). For example, according to example embodiments, for example, rather than combining the Suvin cotton with either of the long staple cotton (LS) or extra long staple cotton (ELS), the long staple cotton (LS) can be combined with the extra long staple cotton (ELS), for example, which is further used to form the fabric. Optionally, a combination of all three cottons can be used to form the fabric.

While the invention has been described with reference to preferred and example embodiments, it will be understood by those skilled in the art that a variety of modifications, additions and deletions are within the scope of the invention, as defined by the following claims.

What is claimed is:

1. A durable and lightweight woven fabric formed from a plurality of warp and weft yarns, the yarn comprising a single-ply yarn having a combination of extra long staple cotton and Suvin cotton, the extra long staple cotton being blended with Suvin cotton at a ratio of between about 85:15 to about 90:10 to form the single-ply yarn, the single-ply yarn having a count of between about 60 s to about 150 s for providing breathability and comfort, wherein the durable and lightweight woven fabric comprises an 8-end sateen weave structure with a float size between about 1 millimeter to about 2 millimeters, wherein the drape coefficient is at least about 40% and generally less than about 60%, wherein the fabric weight is between about 120-200 grams per square meter, wherein the durable and lightweight woven fabric comprises a surface index value of between about 2.4-4.0 on a scale from between a minimum value of about 2 and a maximum value of about 15, wherein the minimum value of about 2 indicates a substantially smooth feel and wherein the maximum value of about 15 indicates a substantially rough feel, and wherein the durable and lightweight woven fabric maintains its drape coefficient and surface index value after numerous washing cycles.

2. The woven fabric of claim 1, wherein the extra long staple cotton is blended with Suvin cotton at a ratio of 85:15.

3. The woven fabric of claim 1, wherein the extra long staple cotton is blended with Suvin cotton at a ratio of 90:10.

4. The woven fabric of claim 1, wherein the drape coefficient is between about 40% to about 50%.

5. The woven fabric of claim 1, wherein the fabric weighs between about 130-195 grams per square meter.

6. The woven fabric of claim 1, wherein with the thread count of the woven fabric being 600, the fabric weighs about 134 grams per square meter, the drape coefficient is about 42%, the crease recovery value in the warp direction is about 140, and the crease recovery value in the weft direction is about 98.

7. The woven fabric of claim 1, wherein with the thread count of the woven fabric being 800, the fabric weighs about 167 grams per square meter, the drape coefficient is about 43%, the crease recovery value in the warp direction is about 135, and the crease recovery value in the weft direction is about 78.

8. The woven fabric of claim 1, wherein with the thread count of the woven fabric being 1000, the fabric weighs about 190 grams per square meter, the drape coefficient is about 47%, the crease recovery value in the warp direction is about 151, and the crease recovery value in the weft direction is about 81.

9. The woven fabric of claim 1, wherein the fabric is in the form of a bedding product selected from at least one of a sheet, a pillow case, a duvet or duvet cover, a blanket, or a quilt.

10. A durable and lightweight woven fabric formed from a plurality of warp and weft yarns to define an 8-end sateen weave structure, the yarn comprising a single-ply yarn having a combination of long staple cotton and Suvin cotton, the long staple cotton being blended with the Suvin cotton at a ratio of between 85:15 to about 90:10, the single-ply warp yarn comprising a count of about 100 s and the single-ply weft yarn comprising a count of between about 120 s-135 s, wherein the drape coefficient is between about 40%-50% and the fabric weighs between about 130-195 grams per square meter, wherein the float size is between about 1 millimeter to about 2 millimeters, wherein the durable and lightweight woven fabric comprises a surface index value of between about 2.4-4.0 on a scale from between a minimum value of about 2 and a maximum value of about 15, wherein the minimum value of about 2 indicates a substantially smooth feel and wherein the maximum value of about 15 indicates a substantially rough feel, and wherein the durable and lightweight woven fabric provides for breathability, comfort, and maintains its drape coefficient and surface index value throughout numerous washing cycles.

11. A method of forming a durable and lightweight fabric comprising a smooth feel with a low surface index value, the durable and lightweight fabric comprising:

loading a first cotton on a ring frame;

loading a second cotton on a ring frame;

spinning the first cotton with the second cotton on the ring fame to form a yarn, wherein the first cotton is blended with the second cotton at a ratio of between about 85:15 to about 90:10 to define a single-ply yarn comprising a count of between about 60 s to about 150 s;

loading the single-ply yarn on a loom; and using the loom to weave the single-ply yarn in the warp and weft directions to form the fabric wherein the float size is between about 1 millimeter and about 2 millimeters, wherein the fabric comprises a weave configuration in the form of an 8-end sateen weave, wherein the low surface index value of the durable and lightweight woven fabric is between about 2.4-4.0 on a scale from between a minimum value of about 2 and a maximum value of about 15, wherein the minimum value of about 2 indicates a substantially smooth feel and wherein the maximum value of about 15 indicates a substantially rough feel, wherein the drape coefficient is between about 40% to about 50%, wherein the fabric weight is between about 120-190 grams per square meter, and wherein the durable and lightweight fabric maintains its drape coefficient and low surface index value after numerous washing cycles.

12. The woven fabric of claim 11, wherein the single-ply yarns of the warp direction comprise a count of about 100 s and the single-ply yarns of the weft direction comprise a count of between about 120 s-135 s.

13. The method of claim 12, wherein the first cotton comprises extra long staple cotton and the second cotton comprises Suvin cotton.

14. The method of claim 12, wherein the first cotton comprises long staple cotton and the second cotton comprises Suvin cotton.

* * * * *